US008265534B2

(12) United States Patent
Hamby et al.

(10) Patent No.: US 8,265,534 B2
(45) Date of Patent: Sep. 11, 2012

(54) APPARATUS AND METHOD FOR AN ASYMMETRICAL PRINTER FUSER NIP

(75) Inventors: Eric Scott Hamby, Webster, NY (US); Faming Li, Penfield, NY (US); Donald M. Bott, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 432 days.

(21) Appl. No.: 12/609,331

(22) Filed: Oct. 30, 2009

(65) Prior Publication Data

US 2011/0103851 A1 May 5, 2011

(51) Int. Cl.
*G03G 15/20* (2006.01)

(52) U.S. Cl. ..... 399/328; 399/334

(58) Field of Classification Search ..... 399/122, 399/328, 329, 334; 219/216
See application file for complete search history.

(56) References Cited

U.S. PATENT DOCUMENTS 5,053,829 A * 10/1991 Field et al. ..... 399/329
6,819,890 B1 11/2004 Bott et al.
7,013,107 B2 3/2006 Russel et al.
7,113,717 B2 9/2006 Bott et al.
7,664,448 B2 * 2/2010 Lee et al. ..... 399/329
7,773,930 B2 * 8/2010 Shin et al. ..... 399/329

OTHER PUBLICATIONS

Eric Scott Hamby et al.; U.S. Appl. No. 12/473,578, filed May 28, 2009.

* cited by examiner

*Primary Examiner* — William J Royer
(74) *Attorney, Agent, or Firm* — Ronald E. Prass, Jr.; PRASS LLP

(57) ABSTRACT

An asymmetrical printer includes a housing (101) and a first fuser member (121) rotationally supported in the housing. The first fuser member has a first fuser member end (210) and a second fuser member end (220). The first fuser member fuses an image on a media sheet traveling in a media sheet 112 travel direction (115). A fuser nip (126) has a fuser nip width dimension (128) parallel to the media sheet travel direction and having a fuser nip length (116) from the first fuser member end to the second fuser member end. The fuser nip length is perpendicular to the media sheet travel direction. The fuser nip width dimension is asymmetrical along the fuser nip length. A second fuser member (122) is rotationally supported in the housing and coupled to the first fuser member at the fuser nip. The second fuser member fuses the image on the media sheet.

20 Claims, 5 Drawing Sheets

APPARATUS AND METHOD FOR AN ASYMMETRICAL PRINTER FUSER NIP

BACKGROUND

Disclosed herein is an apparatus and method for an asymmetrical printer fuser nip.

Presently, image output devices, such as printers, multifunction media devices, xerographic machines, ink jet printers, and other devices, produce images on media sheets, such as paper, substrates, transparencies, plastic, cardboard, or other media sheets. To produce an image, marking material, such as toner, ink jet ink, or other marking material, is applied to a media sheet to create a latent image on the media sheet. A fuser assembly then affixes or fuses the latent image to the media sheet by applying heat and/or pressure to the media sheet.

Fuser assemblies apply pressure using rotational members, such as fuser rolls or belts, that are coupled to each other at a fuser nip. Pressure is applied to the latent image on the media sheet as the media sheet is fed through the fuser nip. Unfortunately, repeated contact between the media sheet edges and a rotational fuser member results in worn areas, also known as edge wear, on the fuser member. The worn areas eventually manifest as differential gloss bands on resulting prints, especially after fusing many sheets of one sheet width followed by fusing sheets of a larger sheet width. For example, a differential gloss band appears on 14" wide media sheets after running a large number of 11" wide media sheets. As it turns out, fuser run cost is a large part of the overall printer marking engine run cost, and edge wear is a leading cause of fusing failure regardless of print engine type, such as mono or color, or market segment, such as office or production. The edge wear occurs in both inboard and outboard areas on fusing members, where the level of wear in either area can dictate edge wear life.

Various methods are used to reduce the impact of edge wear. One solution is to change fuser rolls for different size papers, though this is not always practical. A registration distribution system is another solution that operates by automatically moving the sheet-edge/fuser member contact point back and forth in order to spread the edge wear over a larger area on the fuser member surface. Unfortunately, for some printing devices, edge wear can still be detected as early as about 24,000 prints, even when using a registration distribution system. Moreover, inboard/outboard differences in edge wear are variable and can be large.

Thus, there is a need for an apparatus and method for an asymmetrical printer fuser nip that can reduce the impact of edge wear on prints.

SUMMARY

An apparatus and method for an asymmetrical printer fuser nip is disclosed. The apparatus can include a housing and a first fuser member rotationally supported in the housing. The first fuser member can have a first fuser member end and a second fuser member end. The first fuser member can be configured to fuse an image on a media sheet traveling in a media sheet travel direction. The apparatus can include a fuser nip having a fuser nip width dimension parallel to the media sheet travel direction and having a fuser nip length from the first fuser member end to the second fuser member end. The fuser nip length can be perpendicular to the media sheet travel direction. The fuser nip width dimension can be configured to be asymmetrical along the fuser nip length. The apparatus can include a second fuser member rotationally supported in the housing and coupled to the first fuser member at the fuser nip. The second fuser member can be configured to fuse the image on the media sheet.

BRIEF DESCRIPTION OF THE DRAWINGS

In order to describe the manner in which advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1:
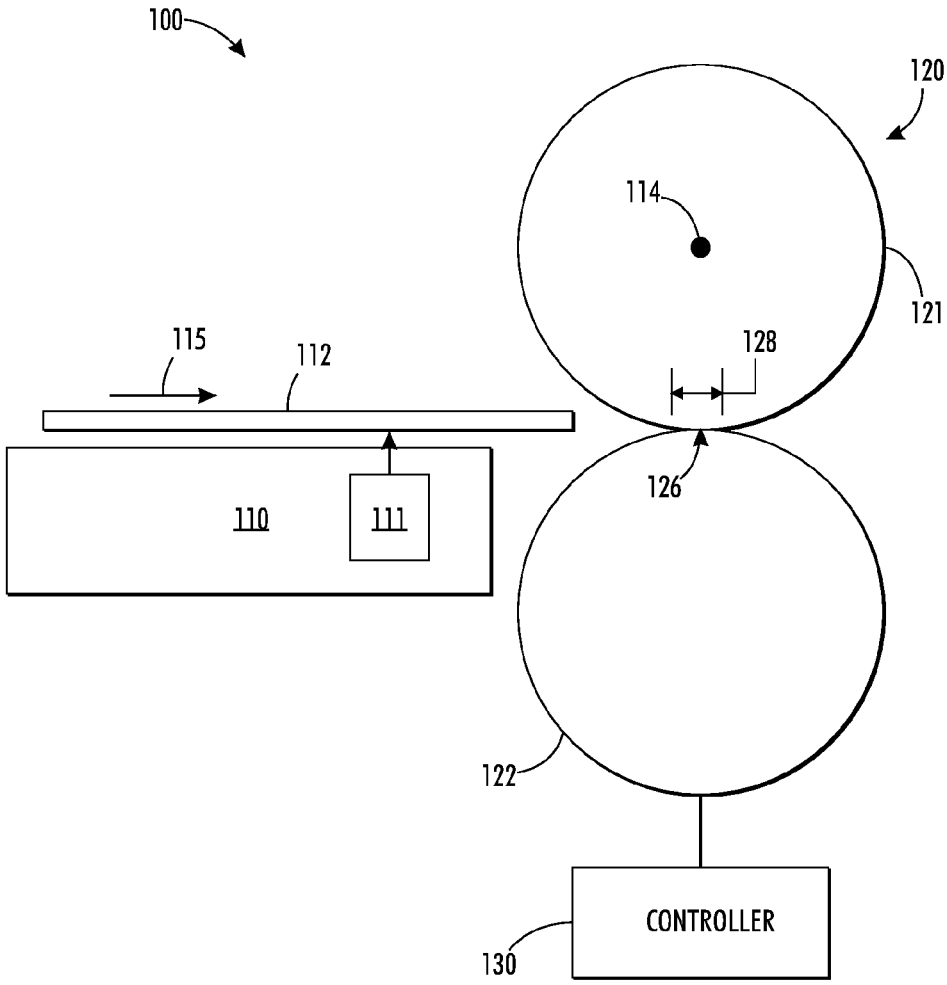
FIG. 1 is an exemplary illustration of a first view of an apparatus.

The embodiments include an apparatus with an asymmetrical printer fuser nip. The apparatus can include a housing and a first fuser member rotationally supported in the housing. The first fuser member can have a first fuser member end and a second fuser member end. The first fuser member can be configured to fuse an image on a media sheet traveling in a media sheet travel direction. The apparatus can include a fuser nip having a fuser nip width dimension parallel to the media sheet travel direction and having a fuser nip length from the first fuser member end to the second fuser member end. The fuser nip length can be perpendicular to the media sheet travel direction. The fuser nip width dimension can be configured to be asymmetrical along the fuser nip length. The apparatus can include a second fuser member rotationally supported in the housing and coupled to the first fuser member at the fuser nip. The second fuser member can be configured to fuse the image on the media sheet.

The embodiments further include a method in an apparatus that can include a first fuser member rotationally supported about an axis of rotation, the first fuser member having a first fuser member end at one end of the axis of rotation and a second fuser member end at another end of the axis of rotation, the apparatus including a fuser nip having a fuser nip width dimension perpendicular to the axis of rotation and having a fuser nip length from the first fuser member end to the second fuser member end, the fuser nip length parallel to the axis of rotation, and the apparatus including a second fuser member rotationally supported in the housing and coupled to the first fuser member at the fuser nip. The method can include adjusting the fuser nip width dimension to be asymmetrical along the fuser nip length. The method can include generating a latent image on a media sheet. The method can include sending the media sheet through the fuser nip. The method can include fusing the image on the media sheet in the fuser nip.

The embodiments further include an apparatus with an asymmetrical printer fuser nip. The apparatus can include a media transport configured to transport a media sheet in a media sheet travel direction. The apparatus can include a housing and a first fuser member rotationally supported in the housing and coupled to the media transport. The first fuser member can have a first fuser member end and a second fuser member end. The first fuser member can be configured to fuse an image on the media sheet, where an edge of the media sheet generates wear on the first fuser member. The apparatus can include a fuser nip having a fuser nip width dimension parallel to the media sheet travel direction and having a fuser nip length from the first fuser member end to the second fuser member end, with the fuser nip length perpendicular to the media sheet travel direction. The fuser nip width dimension can be configured to be asymmetrical along the fuser nip length. The apparatus can include a second fuser member rotationally supported in the housing and coupled to the first fuser member at the fuser nip. The second fuser member can be configured to fuse the image on the media sheet. The apparatus can include a media sheet edge guide configured to guide edges of media sheets at a location along the fuser nip length, where the location along the fuser nip length is substantially common for edges of different media sheet sizes. The fuser nip width dimension can be wider at a location proximal to the location along the fuser nip length substantially common for edges of different media sheet sizes than at a location along the fuser nip length substantially uncommon for other edges of different media sheet sizes.

Figure 2:
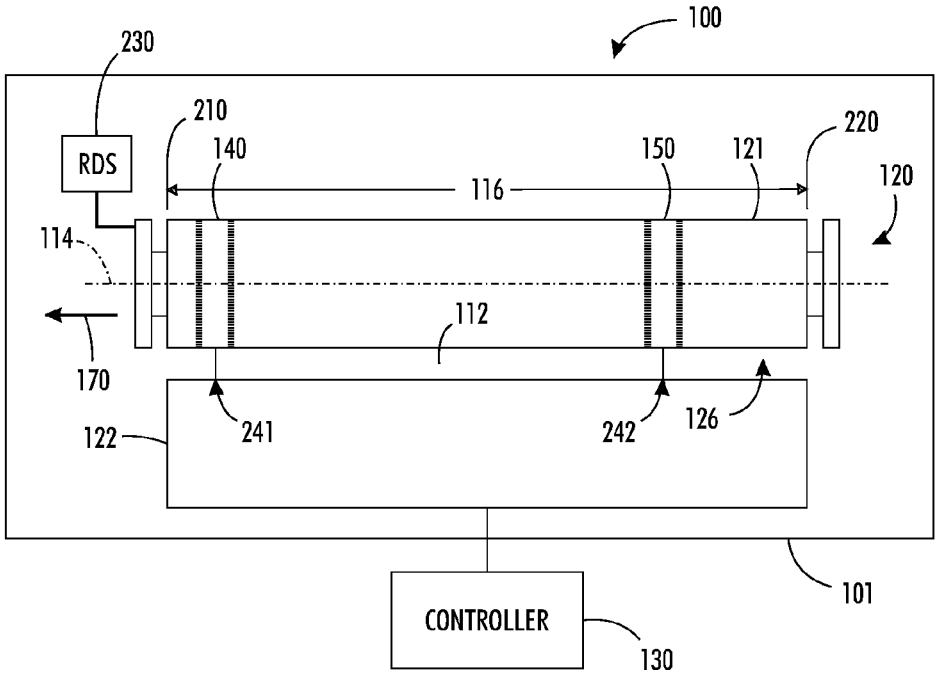
FIG. 2 is an exemplary illustration of a second view of an apparatus, the second view perpendicular to the first view.

FIG. 1 is an exemplary illustration of a first view of an apparatus 100. FIG. 2 is an exemplary illustration of a second view of the apparatus 100, the second view being perpendicular to the first view. The apparatus 100 may be or may be part of a printer, such as a laser printer, an ink jet printer, a copier, a multifunction media device, a xerographic machine, or any other device that generates an image on media. The apparatus 100 can include a housing 101 and a first fuser member 121 rotationally supported in the housing 101. A fuser member may be a belt, a roll, a heated fuser member, a pressure fuser member, or any other fuser member that can provide a fuser nip to fuse an image on a media sheet. The first fuser member 121 can have a first fuser member end 210 and a second fuser member end 220. The first fuser member 121 can be configured to fuse an image on a media sheet 112 traveling in a media sheet travel direction 115. The apparatus 100 can include a fuser nip 126 having a fuser nip width dimension 128 parallel to the media sheet travel direction 115 and having a fuser nip length 116 from the first fuser member end 210 to the second fuser member end 220. The fuser nip length 116 can be perpendicular to the media sheet travel direction 115. The fuser nip width dimension 128 can be configured to be asymmetrical along the fuser nip length 116. The apparatus 100 can include a second fuser member 122 rotationally supported in the housing 101 and coupled to the first fuser member 121 at the fuser nip 126. The second fuser member 122 can be configured to fuse the image on the media sheet 112.

The first fuser member 121 can have an axis of rotation 114. The fuser nip width dimension 128 can be perpendicular to the first fuser member axis of rotation 114. The first fuser member end 210 can be a fuser member outboard end and the second fuser member end 220 can be a fuser member inboard end. The fuser nip width dimension 128 can be larger at the fuser member outboard end 210 than at the fuser member inboard end 220. The fuser nip width dimension 128 can alternately be larger at the fuser member inboard end 220 than at the fuser member outboard end 210 depending on desired operation.

The apparatus 100 can include a media transport 110 including a media sheet edge guide 111 configured to guide edges 241 of media sheets 112 at a location 140 along the fuser nip length 116. The location 140 along the fuser nip length 116 can be substantially common for media sheet edges 241 of different media sheet sizes. The fuser nip width dimension 128 can be wider at a location proximal to the location 140 along the fuser nip length 116 substantially common for media sheet edges 241 of different media sheet sizes than at a location 150 along the fuser nip length 116 substantially uncommon for media sheet edges 242 of different media sheet sizes. The media sheet edge guide 111 can be rollers that adjust the media sheet travel path, can be air guides that adjust the media sheet travel path, can be tracks that guide the media sheet travel path, can be part of a registration distribution system 230 that adjusts the fuser members 121 and 122 relative to the media sheet travel path, or can be any other media sheet edge guide. The media sheet edge guide 111 can also be a system in the media transport 110 that can include independently controller motors that actuate rollers and can include sensors that can detect the spatial location of media sheets 112. The rollers can then steer media sheets 112 into a desired position. Other variations can have balls, air jets, and other mechanical elements along with or instead of rollers. Rollers can also direct a media sheet 112 into a physical boundary that controls the edge 241 location without the use of a sensor.

As another example, the media sheet edge guide 111 can be configured to guide edges 241 of media sheets 112 at a location 140 along the fuser nip length 116. The location 140 along the fuser nip length 116 can be substantially common for media sheet edges 241 of different media sheet sizes. The fuser nip width dimension 128 can be wider at a location proximal to the location 140 along the fuser nip length 116 than at another location 150 along the fuser nip length 116 distal to the location 140 along the fuser nip length for media sheet edges 242 of different media sheet sizes.

The apparatus 100 can include a registration distribution system 230 configured to move the first fuser member 121 in a direction 170 substantially parallel to the fuser nip length 116. The registration distribution system 230 can also move the second fuser member 122 in the direction 170 substantially parallel to the fuser nip length 116. For example, the registration distribution system 230 can move an entire fuser subassembly 120 relative to a media sheet path. As a further example, an edge 241 of the media sheet 112 can generate wear on the first fuser member 121 and the registration distribution system 230 can be configured to move the first fuser member 121 in the direction 170 substantially parallel to the fuser nip length 116 to guide the media sheet 112 away from the wear on the first fuser member 121 proximal to the location 140 along the fuser nip length 116.

As another example, the edge 241 of the media sheet 112 can generate wear on the first fuser member 121 and the wear can generate perceptible differential gloss defects on subsequent media sheets. The registration distribution system 230 can be configured to move the first fuser member 121 in the direction 170 substantially parallel to the fuser nip length 116 to guide the media sheet 112 away from the wear on the first fuser member 121 proximal to the location 140 along the fuser nip length 116 to minimize the perceptible differential gloss defects on media sheets.

The apparatus 100 can include a controller 130 configured to control a speed of the registration distribution system 230 based on a desired acceptable gloss defect on the media sheet 112. For example, if the registration distribution system 230 moves too slowly, gloss may show up on subsequent media sheets and if the registration distribution system 230 moves too fast, the registration distribution system 230 may get to the end of the first fuser member 121 while still allowing for more wear on the first fuser member 121 within acceptable gloss defect tolerances.

The fuser nip width dimension 128 can be configured to be asymmetrical based on a media type of the media sheet 112. For example, the media type may include factors relating to a thickness of the media sheet 112, a coating type on the media sheet 112, a glossiness of the media sheet 112, attributes of the media sheet 112 relating to gloss defects on the media sheet 112, and other media type factors. The controller 130 can automatically adjust the fuser nip width dimension 128 based on information about the media sheet type.

Elements of the illustrations may be exaggerated for illustrative purposes and the elements are not necessarily drawn to scale. For example, the fuser members 121 and 122 generally contact each other to create the fuser nip 126 and the apparent gap between the fuser members 121 and 122 in FIG. 2 may only exist in the drawing to show the presence of the media sheet 112. Portions of the fuser members 121 and 122 can be deformable and can contact each other at the fuser nip 126 outside of the edges of the media sheet 112.

According to a related embodiment, the apparatus 100 can include a media transport 110 configured to transport a media sheet 112 in a media sheet travel direction 115. The apparatus 100 can include a housing 101 and a first fuser member 121 rotationally 121 supported in the housing 101 and coupled to the media transport 110. The first fuser member 121 can have a first fuser member end 210 and a second fuser member end 220. The first fuser member 121 can be configured to fuse an image on the media sheet 112, where an edge 241 of the media sheet 112 can generate wear on the first fuser member 121. The apparatus 100 can include a fuser nip 126 having a fuser nip width dimension 128 parallel to the media sheet travel direction 115 and having a fuser nip length 116 from the first fuser member end 210 to the second fuser member end 220. The fuser nip length 116 can be perpendicular to the media sheet travel direction 115 and the fuser nip width dimension 128 can be configured to be asymmetrical along the fuser nip length 116. The apparatus 100 can include a second fuser member 122 rotationally supported in the housing 101 and coupled to the first fuser member 121 at the fuser nip 126. The second fuser member 122 in combination with the first fuser member 121 can be configured to fuse the image on the media sheet 112. The apparatus 100 can include a media sheet edge guide 111 configured to guide edges 241 of media sheets 112 at a location 140 along the fuser nip length 116. The location 140 along the fuser nip length 116 can be substantially common for edges 241 of different media sheet sizes. The fuser nip width dimension 128 can be wider at a location proximal to the location 140 along the fuser nip length 116 substantially common for edges 241 of different media sheet sizes than at a location 150 along the fuser nip length substantially uncommon for other edges 242 of different media sheet sizes.

The apparatus 100 can include a registration distribution system 230 configured to move the first fuser member 121 in a direction 170 substantially parallel to the fuser nip length 116. The media sheet 112 can generate wear on the first fuser member 121. The registration distribution system 230 can be configured to move the first fuser member 121 in the direction 170 substantially parallel to the fuser nip length 116 to guide the media sheet 112 away from the wear on the first fuser member 121 proximal to the location 140 along the fuser nip length 116.

Embodiments can provide for an asymmetric fuser nip coupled with registration distribution system to mitigate edge wear. Edge wear life can be increased by combining an asymmetric fuser nip with a registration distribution system mechanism operating in a one-way mode for an edge registered printing system. For an outboard edge registered system, the inboard/outboard fuser nip loading can be adjusted so that the outboard fuser nip width is slightly larger than the inboard fuser nip width. This has the effect of concentrating the edge wear on the outboard side of the fuser roll while at the same time minimizing edge wear on the inboard side, which can be useful because in certain printing systems differential gloss defects due to edge wear can often appear on the inboard side of the print when printing on wider sheets. A typical registration distribution system can operate by moving a fuser back and forth at a constant speed relative to the fixed paper path, thereby spreading out the wear on the fuser roll caused by contact with sheet edges. To avoid differential gloss defects associated with the edge wear on the outboard side of the fuser, the registration distribution system can operate in a one-way mode to move the concentrated wear area on the fuser away from the customer prints. A combination of experiments, modeling, and simulation suggest that the proposed approach can improve edge wear life by three times or more.

Figure 3:
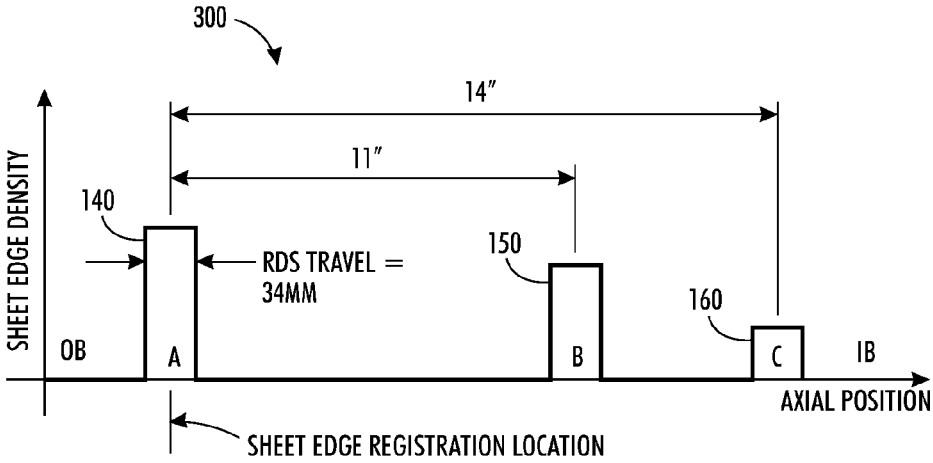
FIG. 3 is an exemplary graph of sheet edge density.

FIG. 3 is an exemplary graphical illustration 300 of sheet edge density (edges/mm) accumulation on a fuser member 121 for an outboard edge registered print engine employing a registration distribution system. Because the system is outboard edge registered, the outboard portion of the fuser member always comes into contact with sheet edges so that the outboard media sheet edge density at location 140 can be determined by print count and registration distribution system travel distance. The inboard edge density, on the other hand, can depend on sheet size, such as 11 inch media sheet edge density at location 150 and 14 inch media sheet edge density at location 160. Typically, edge wear in the area of location 150 is a key concern because wear in this location can manifest as differential gloss in wider prints, such as on images on 14 inch media sheets. In a system using a registration distribution system travel with a width of 34 mm, differential gloss due to edge wear can also appear outboard by location 140, especially in bleed-edge print applications where the image covers the entire media sheet without having a border at the edge of the sheet.

Observed edge wear life can vary widely from machine to machine. It can be common for some users to change fuser rolls due to edge wear approximately every 50,000 prints. The financial impact of these users can be significant. Inboard/outboard differences in edge wear can vary across the machine population as well as within a given machine. Experiments investigating the root cause of edge wear for some machines show that edge wear is sensitive to nip width variation. More specifically, the experiments show that changing the nip width profile within a machine's current outboard/inboard specification, such as 14.5 mm +/−0.5 mm, can change the outboard/inboard differential gloss in a standard edge wear life test by an order of magnitude.

Figure 4:
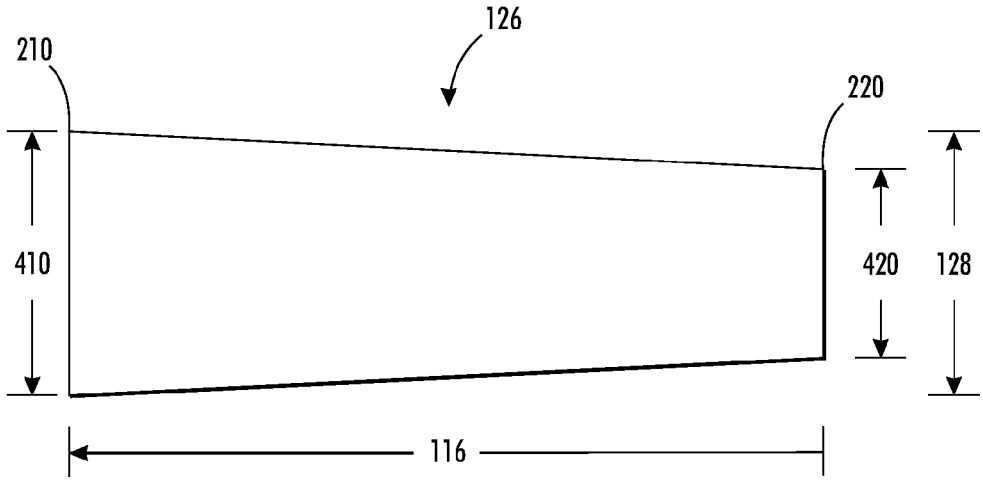
FIG. 4 is an exemplary illustration of a fuser nip.

FIG. 4 is an exemplary top view illustration of the fuser nip 126. The actual dimensions of the fuser nip 126 may be exaggerated for illustrative purposes. Currently, a typical nominal fuser nip width profile for some machines is uniform at about 14.5 mm from inboard to outboard. Embodiments can provide an asymmetric fuser nip width that is weighted towards the outboard side. Alternately, embodiments can provide an asymmetric fuser nip width that is weighted towards the inboard side or a side that is not related to an inboard/outboard reference point. For example, the fuser nip width 128 can have a wider width 410 at a first fuser member end 210 along the fuser nip length 116 than a width 420 at a second fuser member end 220 along the fuser nip length 116.

Embodiments can concentrate edge wear on one side, such as on an outboard side, of a fuser member and then use a registration distribution system to transport the worn area away from the resulting prints so that the edge wear does not cause perceptible differential gloss defects on the prints. For an outboard edge registered system, one way to ensure that the outboard edge wear zone does not impact prints can be to have registration distribution system operate in only one direction, such as by moving the fuser in an outboard direction.

Embodiments having an asymmetric fuser nip were compared to systems using a symmetric fuser nip under an edge wear life test scenario. In this scenario, an edge wear model was used to compute the sheet edge density that will result in just perceptible differential gloss on a test target. Even though the asymmetric nip width profile was asymmetric, it can still fall within the current print machine specifications. Total registration distribution system travel in both cases was assumed to be 34 mm, which corresponds to selected current machine values. Other registration distribution system travel can be used depending on the type of machine and desired results.

For some asymmetric nip embodiments, edge wear life can be determined by the inboard side since the registration distribution system motion continuously moves the outboard wear zone away from the prints. On the other hand, edge wear life for the symmetric nip approach is dictated by the minimum of the outboard/inboard sheet densities because the back and forth registration distribution system motion means that either wear area can impact the print. Therefore, the asymmetric nip embodiments reaches the differential gloss perceptibility threshold at a sheet edge density of 2.1 Kedges/mm; whereas, the symmetric approach reaches the failure boundary in only 0.7 Kedges/mm. For 34 mm of registration distribution system travel, this means that the asymmetric nip embodiments can have an edge wear life of about 70,000 sheets while the symmetric approach would have an edge wear life of about 24,000 sheets, which indicates almost a 3× improvement in edge wear life.

The registration distribution system speed for some embodiments can be computed by dividing the print rate by the sheet edge density. This can result in a registration distribution system speed of 0.05 mm/min. An example of current print machine registration distribution system speed is 1 mm/min. Motor choice and gear selection can be used to achieve a reduced registration distribution system speed. Furthermore, the registration distribution system speed in some embodiments can be a function of customer preference. Sheet edge densities can scale with customer acceptable levels of differential gloss, which, in turn, can drive the required registration distribution system speed. Also, because edge wear can vary as a function of media type, the nip width asymmetry can be a function of media type.

Figure 5:
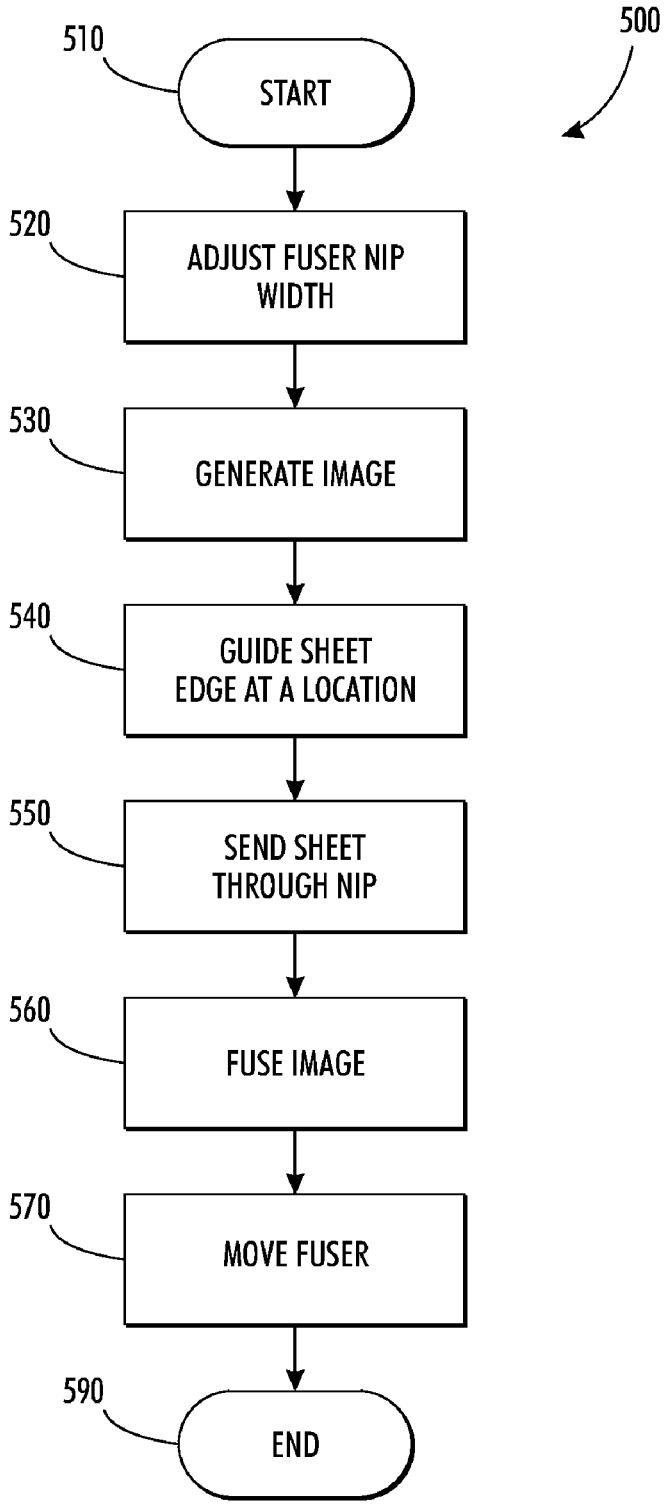
FIG. 5 illustrates an exemplary flowchart of a method in an apparatus.

FIG. 5 illustrates an exemplary flowchart of a method 500 in an apparatus that can include a first fuser member rotationally supported about an axis of rotation, where the first fuser member can have a first fuser member end at one end of the axis of rotation and a second fuser member end at another end of the axis of rotation. The first fuser member end can be a fuser member outboard end and the second fuser member end can be a fuser member inboard end. Alternately, the ends may be switched or may not be related to an inboard and outboard end. The apparatus can include a fuser nip having a fuser nip width dimension perpendicular to the axis of rotation and having a fuser nip length from the first fuser member end to the second fuser member end, where the fuser nip length can be parallel to the axis of rotation. The apparatus can include a second fuser member rotationally supported in the housing and coupled to the first fuser member at the fuser nip.

The method starts at 510. At 520, the fuser nip width dimension can be adjusted to be asymmetrical along the fuser nip length. The fuser nip width dimension can be adjusted by adjusting the fuser nip width dimension to be larger at the first fuser member end than at the second fuser member end. For example, the fuser nip width dimension can be adjusted by adjusting the fuser nip width dimension to be larger at the fuser member outboard end than at the fuser member inboard end. The fuser nip width dimension can be adjusted by adjusting the fuser nip width dimension to be asymmetrical along the fuser nip length based on a media type of a media sheet to be fed through the fuser nip.

At 530, a latent image can be generated on a media sheet. The media sheet can be a first media sheet of a first size. At 540, an edge of the first media sheet can be guided at a first location along the fuser nip length. Also, an edge of a second media sheet can be guided at substantially the same location along the fuser nip length as the first location, where the second media sheet can be of a different size from the first media sheet. The second media sheet can be guided during another iteration of the method. For example, the second media sheet can be any media sheet of a different size fed through the fuser nip at any other time from a time when the first media sheet is fed through the fuser nip. The fuser nip width dimension can be wider at the first location along the fuser nip length than at a second location distal to the first location along the fuser nip length.

At 550, the media sheet can be sent through the fuser nip. Wear can be generated on the first fuser member from an edge of the media sheet when the media sheet is sent through the fuser nip. For example, wear can be generated on the first fuser member from an edge of the media sheet where the wear can generate perceptible differential gloss defects on the media sheet. At 560, the latent image can be fused on the media sheet in the fuser nip.

At 570, the first fuser member can be moved in a direction substantially parallel to the fuser nip length. For example, the first fuser member can be moved in a direction substantially parallel to the fuser nip length to guide the media sheet away from the wear on the first fuser member proximal to the first location along the fuser nip length. As a further example, the first fuser member can be moved in a direction substantially parallel to the fuser nip length to guide the media sheet away from the wear on the first fuser member proximal to the location along the fuser nip length to minimize the perceptible differential gloss defects on the media sheet. The first fuser member can be moved using a registration distribution system and a speed of the registration distribution system can be controlled based on a desired acceptable gloss defect on the media sheet. At 590, the method 500 can end.

Figure 6:
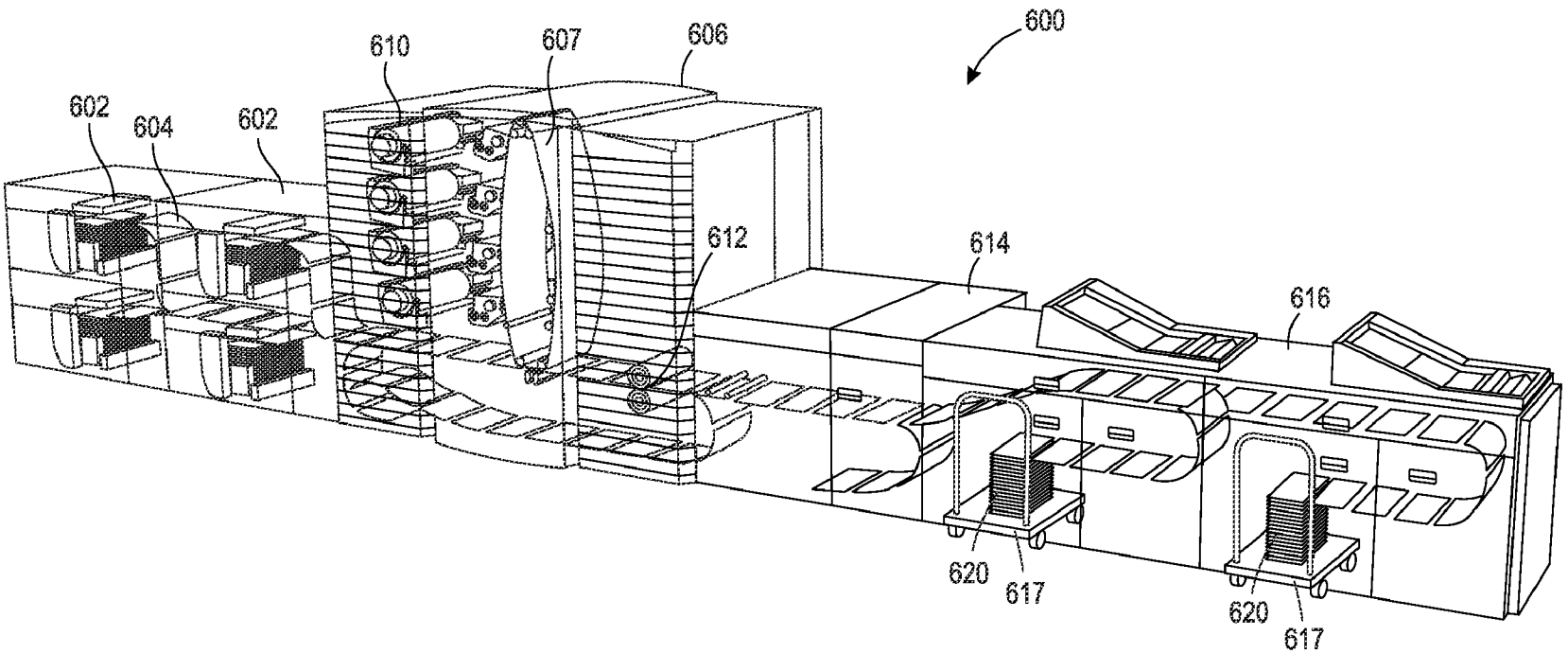
FIG. 6 illustrates an exemplary printing apparatus.

FIG. 6 illustrates an exemplary printing apparatus 600. As used herein, the term "printing apparatus" encompasses any apparatus, such as a digital copier, bookmaking machine, multifunction machine, and other printing devices that perform a print outputting function for any purpose. The printing apparatus 600 can be used to produce prints from various media, such as coated, uncoated, previously marked, or plain paper sheets. The media can have various sizes and weights. In some embodiments, the printing apparatus 600 can have a modular construction. As shown, the printing apparatus 600 can include at least one media feeder module 602, a printer module 606 adjacent the media feeder module 602, an inverter module 614 adjacent the printer module 606, and at least one stacker module 616 adjacent the inverter module 614.

In the printing apparatus 600, the media feeder module 602 can be adapted to feed media 604 having various sizes, widths, lengths, and weights to the printer module 606. In the printer module 606, marking material, such as toner, is transferred from an arrangement of developer stations 610 to a charged photoreceptor belt 607 to form marking material images on the photoreceptor belt 607. The marking material images are transferred to the media 604 fed through a paper path. The media 604 are advanced through a fuser 612, such as the apparatus 100, adapted to fuse the marking material images on the media 604. The inverter module 614 manipulates the media 604 exiting the printer module 606 by either passing the media 604 through to the stacker module 616, or by inverting and returning the media 604 to the printer module 606. In the stacker module 616, printed media are loaded onto stacker carts 617 to form stacks 620.

Although some embodiments of the above description are directed toward a fuser used in xerographic printing, it will be understood that the teachings and claims herein can be applied to any treatment of marking material on a medium. For example, the marking material may comprise liquid or gel ink, and/or heat- or radiation-curable ink; and/or the medium itself may have certain requirements, such as temperature, for successful printing. The heat, pressure and other conditions required for treatment of the ink on the medium in a given embodiment may be different from those suitable for xerographic fusing.

Embodiments may be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. An apparatus comprising:

a housing;

a first fuser member rotationally supported in the housing, the first fuser member having a first fuser member end and a second fuser member end, the first fuser member configured to fuse an image on a media sheet traveling in a media sheet travel direction;

a fuser nip having a fuser nip width dimension parallel to the media sheet travel direction and having a fuser nip length from the first fuser member end to the second fuser member end, the fuser nip length perpendicular to the media sheet travel direction, where the fuser nip width dimension is configured to be asymmetrical along the fuser nip length; and a second fuser member rotationally supported in the housing and coupled to the first fuser member at the fuser nip, the second fuser member configured to fuse the image on the media sheet.

2. The apparatus according to claim 1, wherein the first fuser member has an axis of rotation, and wherein the fuser nip width dimension is perpendicular to the first fuser member axis of rotation.

3. The apparatus according to claim 1, wherein the first fuser member end comprises a fuser member outboard end and wherein the second fuser member end comprises a fuser member inboard end, and wherein the fuser nip width dimension is larger at the fuser member outboard end than at the fuser member inboard end.

4. The apparatus according to claim 1, further comprising a media sheet edge guide configured to guide edges of media sheets at a location along the fuser nip length, the location along the fuser nip length being substantially common for media sheet edges of different media sheet sizes, wherein the fuser nip width dimension is wider at a location proximal to the location along the fuser nip length substantially common for media sheet edges of different media sheet sizes than at a location along the fuser nip length substantially uncommon for media sheet edges of different media sheet sizes.

5. The apparatus according to claim 1, further comprising a media sheet edge guide configured to guide edges of media sheets at a location along the fuser nip length, the location along the fuser nip length being substantially common for media sheet edges of different media sheet sizes, wherein the fuser nip width dimension is wider at a location proximal to the location along the fuser nip length than at another location along the fuser nip length distal to the location along the fuser nip length for media sheet edges of different media sheet sizes.

6. The apparatus according to claim 5, further comprising a registration distribution system configured to move the first fuser member in a direction substantially parallel to the fuser nip length.

7. The apparatus according to claim 6, wherein an edge of the media sheet generates wear on the first fuser member, and wherein the registration distribution system is configured to move the first fuser member in a direction substantially parallel to the fuser nip length to guide the media sheet away from the wear on the first fuser member proximal to the location along the fuser nip length.

8. The apparatus according to claim 7, wherein the edge of the media sheet generates wear on the first fuser member and the wear generates perceptible differential gloss defects on media sheets, and wherein the registration distribution system is configured to move the first fuser member in a direction substantially parallel to the fuser nip length to guide the media sheet away from the wear on the first fuser member proximal to the location along the fuser nip length to minimize the perceptible differential gloss defects on media sheets.

9. The apparatus according to claim 8, further comprising a controller configured to control a speed of the registration distribution system based on a desired acceptable gloss defect on the media sheet.

10. The apparatus according to claim 1, wherein the fuser nip width dimension is configured to be asymmetrical based on a media type of the media sheet.

11. A method in an apparatus including a first fuser member rotationally supported in a housing about an axis of rotation, the first fuser member having a first fuser member end at one end of the axis of rotation and a second fuser member end at another end of the axis of rotation, the apparatus including a fuser nip having a fuser nip width dimension perpendicular to the axis of rotation and having a fuser nip length from the first fuser member end to the second fuser member end, the fuser nip length parallel to the axis of rotation, and the apparatus including a second fuser member rotationally supported in the housing and coupled to the first fuser member at the fuser nip, the method comprising:

adjusting the fuser nip width dimension to be asymmetrical along the fuser nip length;

generating a latent image on a media sheet;

sending the media sheet through the fuser nip; and fusing the latent image on the media sheet in the fuser nip.

12. The method according to claim 11, wherein the first fuser member end comprises a fuser member outboard end and wherein the second fuser member end comprises a fuser member inboard end, and wherein adjusting the fuser nip width dimension comprises adjusting the fuser nip width dimension to be larger at the fuser member outboard end than at the fuser member inboard end.

13. The method according to claim 11, wherein the media sheet comprises a first media sheet of a first size, wherein the method further comprises:

guiding an edge of the first media sheet at a first location along the fuser nip length; and guiding an edge of a second media sheet at substantially the same location along the fuser nip length as the first location, the second media sheet being of a different size from the first media sheet, and wherein the fuser nip width dimension is wider at the first location along the fuser nip length than at a second location distal to the first location along the fuser nip length.

14. The method according to claim 13, further comprising moving the first fuser member in a direction substantially parallel to the fuser nip length.

15. The method according to claim 13, further comprising:

generating wear on the first fuser member from an edge of the media sheet; and moving the first fuser member in a direction substantially parallel to the fuser nip length to guide the media sheet away from the wear on the first fuser member proximal to the first location along the fuser nip length.

16. The method according to claim 13, further comprising:

generating wear on the first fuser member from an edge of the media sheet where the wear generates perceptible differential gloss defects on the media sheet; and moving the first fuser member in a direction substantially parallel to the fuser nip length to guide the media sheet away from the wear on the first fuser member proximal to the location along the fuser nip length to minimize the perceptible differential gloss defects on the media sheet.

17. The method according to claim 16, wherein moving the first fuser member comprises moving the first fuser member using a registration distribution system, and wherein the method further comprises controlling speed of the registration distribution system based on a desired acceptable gloss defect on the media sheet.

18. The method according to claim 11, wherein adjusting the fuser nip width dimension comprises adjusting the fuser nip width dimension to be asymmetrical along the fuser nip length based on a media type of a media sheet to be fed through the fuser nip.

19. An apparatus comprising:

a media transport configured to transport a media sheet in a media sheet travel direction;

a housing;

a first fuser member rotationally supported in the housing and coupled to the media transport, the first fuser member having a first fuser member end and a second fuser member end, the first fuser member configured to fuse an image on the media sheet, where an edge of the media sheet generates wear on the first fuser member;

a fuser nip having a fuser nip width dimension parallel to the media sheet travel direction and having a fuser nip length from the first fuser member end to the second fuser member end, the fuser nip length perpendicular to the media sheet travel direction, where the fuser nip width dimension is configured to be asymmetrical along the fuser nip length;

a second fuser member rotationally supported in the housing and coupled to the first fuser member at the fuser nip, the second fuser member configured to fuse the image on the media sheet; and a media sheet edge guide configured to guide edges of media sheets at a location along the fuser nip length, the location along the fuser nip length being substantially common for edges of different media sheet sizes, wherein the fuser nip width dimension is wider at a location proximal to the location along the fuser nip length substantially common for edges of different media sheet sizes than at a location along the fuser nip length substantially uncommon for other edges of different media sheet sizes.

20. The apparatus according to claim 19, further comprising a registration distribution system configured to move the first fuser member in a direction substantially parallel to the fuser nip length, wherein the media sheet generates wear on the first fuser member, and wherein the registration distribution system is configured to move the first fuser member in a direction substantially parallel to the fuser nip length to guide the media sheet away from the wear on the first fuser member proximal to the location along the fuser nip length.

* * * * *